US006677582B2

(12) United States Patent
Yamada et al.

(10) Patent No.: US 6,677,582 B2
(45) Date of Patent: Jan. 13, 2004

(54) ION SOURCE AND MASS SPECTROMETER

(75) Inventors: Masuyoshi Yamada, Ichikawa (JP); Yasuaki Takada, Kiyose (JP); Masao Suga, Hachioji (JP)

(73) Assignee: Hitachi, Ltd., Tokyo (JP)

( * ) Notice: Subject to any disclaimer, the term of this patent is extended or adjusted under 35 U.S.C. 154(b) by 134 days.

(21) Appl. No.: 09/941,547

(22) Filed: Aug. 30, 2001

(65) Prior Publication Data

US 2002/0190201 A1 Dec. 19, 2002

(30) Foreign Application Priority Data

Jun. 13, 2001 (JP) ..... 2001-177926

(51) Int. Cl.[7] ..... H01J 49/10

(52) U.S. Cl. ..... 250/288; 250/281; 250/282; 250/425; 361/213; 361/229; 361/230; 361/231; 361/212

(58) Field of Search ..... 250/288, 281, 250/282, 425, 262; 361/213, 229, 230, 231, 212

(56) References Cited

U.S. PATENT DOCUMENTS 5,847,917 A * 12/1998 Suzuki
6,483,108 B1 * 11/2002 Sakairi
6,583,407 B1 * 6/2003 Fischer et al.

OTHER PUBLICATIONS

Pub. No: US 2003/0020013 A1 of Jan. 30, 2003, "Analytical Apparatus", by M. Sakairi.*

* cited by examiner

*Primary Examiner*—John R. Lee
*Assistant Examiner*—Zia R. Hashmi
(74) *Attorney, Agent, or Firm*—Antonelli, Terry, Stout & Kraus, LLP

(57) ABSTRACT

An apparatus for detecting the minor constituents of a sample with high efficiency in positive and negative ion monitoring modes. The directions in which the sample gas is forced to flow in the ionized region within the ion source are properly switched in the positive and negative ion monitoring modes, respectively, thereby enabling both positive ions and negative ions to be detected with high sensitivity.

9 Claims, 9 Drawing Sheets

(a) HIGH-FREQUENCY VOLTAGE ON RING ELECTRODE
(b) VOLTAGE ON GATE ELECTRODE
(c) MODE OF ION OPTICS, MODE OF IONIZATION, MODE OF DEFECTION, MODE OF FLOW DIRECTION

ION SOURCE AND MASS SPECTROMETER

BACKGROUND OF THE INVENTION

The present invention relates to an ion source, a mass spectrometer and mass spectrometry using the same, and an instrumental system using the same or a monitor using the ion source.

The minor constituents in air or liquid have so far been detected with high sensitivity by ionizing the sample to be measured, and detecting the ions on a mass spectrometer.

The atmospheric pressure chemical ionization method using corona discharge is one of the methods of ionizing the collected sample. In this method, as disclosed in JP-A-51-8996, a high voltage is applied, and the sample is introduced into the corona discharge region generated at the tip of a needle electrode, and ionized. When the negative ions are measured by use of the atmospheric pressure chemical ionization method, as disclosed in JP-A-2001-93461 and Japanese Patent Application No. 2000-247937, the sample gas introduced into the corona discharge region is forced to flow in a direction different from the direction of the ions, thereby enabling the minor constituents of the sample gas to be detected with high sensitivity.

However, in the prior art described in JP-A-51-8996, JP-A-2001-93461 and Japanese Patent Application No. 2000-247937, there is no description of how the sample should be introduced into the ion source in order that both positive ions and negative ions can be measured with high sensitivity.

SUMMARY OF THE INVENTION

Accordingly, it is an object of the invention to provide an ion source using corona discharge and a system using the same, in order to measure both positive ions and negative ions with high sensitivity.

When the minor constituents of air are ionized by the atmospheric pressure chemical ionization method using corona discharge, the following reactions can be considered to occur. To the needle electrode where corona discharge is to be caused, is applied a positive high voltage when the sample is to be positively ionized, or a negative high voltage when the sample is to be negatively ionized.

(Positive ionization)

$$N_2+e^- \rightarrow N_2^+ + 2e^-$$

(Positive corona discharge)

$$N_2^+ + 2N_2 \rightarrow N_4^+ + N_2$$

$$N_4^+ + M \rightarrow M^+ + 2N_2$$

First, $N_2$ molecules of air are non-selectively ionized by corona discharge, and then the electric charges are selectively shifted to the molecules of low-ionization energy by ion molecule reaction, thus producing ionized molecules M that are to be measured.

When the sample gas contains moisture, water cluster ions are produced as given below, thereby suppressing the reaction for producing the above $M^+$ ions, with the result that the sensitivity is lowered.

$$N_4^+ + H_2O \rightarrow H_2O^+ + 2N_2$$

$$H_2O^+ + H_2O \rightarrow H_3O^+ + OH$$

$$H^+(H_2O)_{n-1} + H_2O + N_2 \rightarrow H^+(H_2O)_n + N_2$$

In order to prevent this suppression, a cooler is provided to remove the moisture from the sample gas before the sample gas is introduced into the ion source, so that the sensitivity can be improved. When the sample gas has low volatility enough to adhere to the inner wall of the cooler, the cooler is not used, and instead the temperature of the ion source and the first ion sampling aperture is raised to suppress the clustering of water so that the sensitivity can be improved.

(Negative ionization)

$$O_2+e^- \rightarrow O_2^-$$

(Negative corona discharge)

$$O_2+N_2 \rightarrow 2NO$$

(Negative corona discharge)

$$O_2^- + NO \rightarrow NO_3^-$$

$$O_2^- + M \rightarrow (M\text{-}H)^- + HO_2$$

where $(M\text{-}H)^-$ is the negative ion of M with a proton removed. In the case of negative ionization, molecules M are ionized through ions $O_2^-$ resulting from non-selective ionization by corona discharge. In this case, the intermediate NO produced at the same time easily changes to $NO_3^{31}$, and is observed as strong ions. Since $NO_3^-$ has a high degree of acidity, it often does not react with molecules M. Therefore, when the concentration of $N_2$ is much higher than M, the $NO_3^-$ is nearly always observed, but $(M\text{-}H)^-$ is less observed. In order to increase the efficiency of the production of $(M\text{-}H)^-$, it is necessary that the direction in which $O_3^-$ ion is moved by the electric field be made different from the direction in which the intermediate NO moves together with the flow, and that the time for which the intermediate exists in the corona discharge region be decreased as much as possible. In other words, when the corona discharge is caused at the tip of the needle electrode by the application of a high voltage, the direction in which the needle electrode is connected to a partition wall having an opening through which the generated ions are introduced into the mass spectrometry portion, or the direction in which the ions are extracted from the discharge region, is made different from the direction of the flow of the sample gas, thereby greatly increasing the ionization efficiency of the sample.

In the case of positive ionization, since the charge of ion $N_2^+$ is never taken by the produced intermediate. Therefore, in order to efficiently detect the ions of the desired constituent, it is necessary that the directions in which the ions and the sample gas are moved be made the same so that the sample gas flow does not interfere with the ion movement.

DETAILED DESCRIPTION OF THE INVENTION

Embodiments of the invention will be described with reference to the accompanying drawings.

Figure 1:
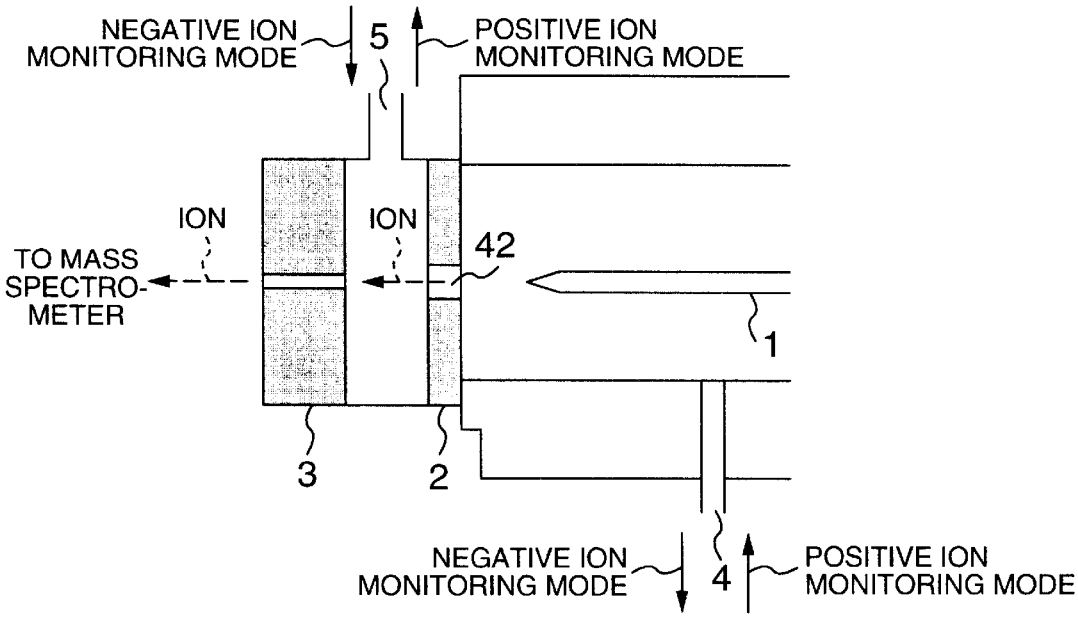
FIG. 1 is a diagram showing an example of the construction of the ion source according to the invention.

FIG. 1 is a diagram showing a construction of an ion source of an embodiment according to the invention. The positive ionization will be first described. A voltage of about +1~10 kV is applied to an needle electrode 1, causing a corona discharge between the needle and a draw-out electrode 2. The generated ions are forced to flow by the electric field, and introduced via a first aperture 3 into a mass spectrometer. In this case, if different voltages are respectively applied to the first aperture 3, draw-out electrode 2 and needle electrode 1 so that the applied voltages satisfy the condition of (the voltage at first aperture 3<the voltage at draw-out electrode 2<the voltage at needle electrode 1), the positive ions can be drawn by the electric field in the mass spectrometer. At this time, if the sample gas is introduced from an opening 4 provided on the back side of the needlepoint, and discharged via the aperture of draw-out electrode 2 from another opening 5, the directions in which the ions and the gas flow are the same in the region ionized by the corona discharge. Thus, the positive ions under consideration can be detected with high efficiency. This ionized region can be considered to be almost the same as the corona discharge region.

In the negative ionization mode, negative voltages are applied contrary to the above case. That is, a negative, high voltage (−1~10 kV) is applied to the needle electrode 1, and negative lower voltages to the draw-out electrode 2 and first aperture 3, of which the voltage values are reduced more in this order than the needle electrode voltage. Thus, the negative ions are forced to flow by the electric field, and drawn in the mass spectrometer via the first aperture 3. In this case, in order that the reaction between the intermediate NO and ion $O_3^-$ can be suppressed, it is more satisfactory that the sample gas be introduced from the opening 5 and discharged from the opening 4 via the first opening 42 which the generated ions are also passed through.

Figure 2:
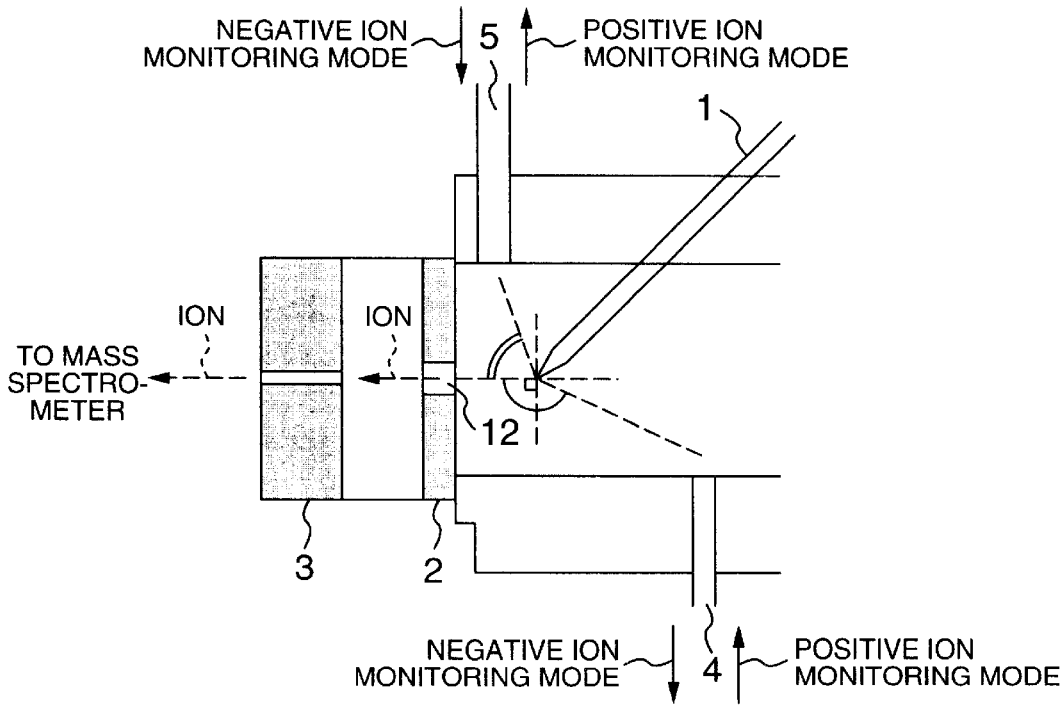
FIG. 2 is a diagram showing another example of the construction of the ion source according to the invention.

FIG. 2 is a diagram showing another construction of the ion source as well as in FIG. 1. The position of the opening 5 and the orientation of the needle are different from those in FIG. 1. The first opening 42 in the construction of FIG. 1 serves both as the inlet/outlet of the sample and as the inlet of the ions, while the first opening 42 (aperture) in FIG. 2 is not used for the inlet/outlet of the sample, but provided only for the introduction of the ions. In the construction of FIG. 2, the needle electrode 1 is not necessarily directed toward the first opening 42, but the openings 5 and 4 are required to be located before and back the tip of the needle electrode, respectively. The construction shown in FIG. 1 also needs to have this positional relation between the openings 5 and 4, otherwise it would be difficult to form the flow of gas that can remove the intermediate generated at the tip of the needle electrode when the negative ions are produced. In FIG. 2, this positional relation is shown by the angles formed between the central axis of the first opening 42 and the line segments respectively connecting the needlepoint and the openings 4 and 5. In FIG. 2, the central axis of the first opening 42 is indicated by the dotted line extending from the needlepoint to the first opening 42. Also, the dotted line extending from the needlepoint to the fourth opening 4 indicates an imaginary line segment connecting the needlepoint and the central axis of the opening 4. More specifically, this imaginary line segment connects the needlepoint and the point at which the central axis of the opening 4 intersects with the inner wall of the chamber in which the needle electrode is provided. The dotted line extending from the needlepoint to the opening 5 indicates an imaginary line segment having the same meaning as above. In the above positional relation, an angle of more than 90 degrees is formed by the line segment connecting the needlepoint and the central axis of the opening 4, and the central axis of the first opening 42, and an angle of less than 90 degrees is formed by the line-segment connecting the needlepoint and the central axis of the opening 5 and the central axis of the first opening 42.

Figure 3:
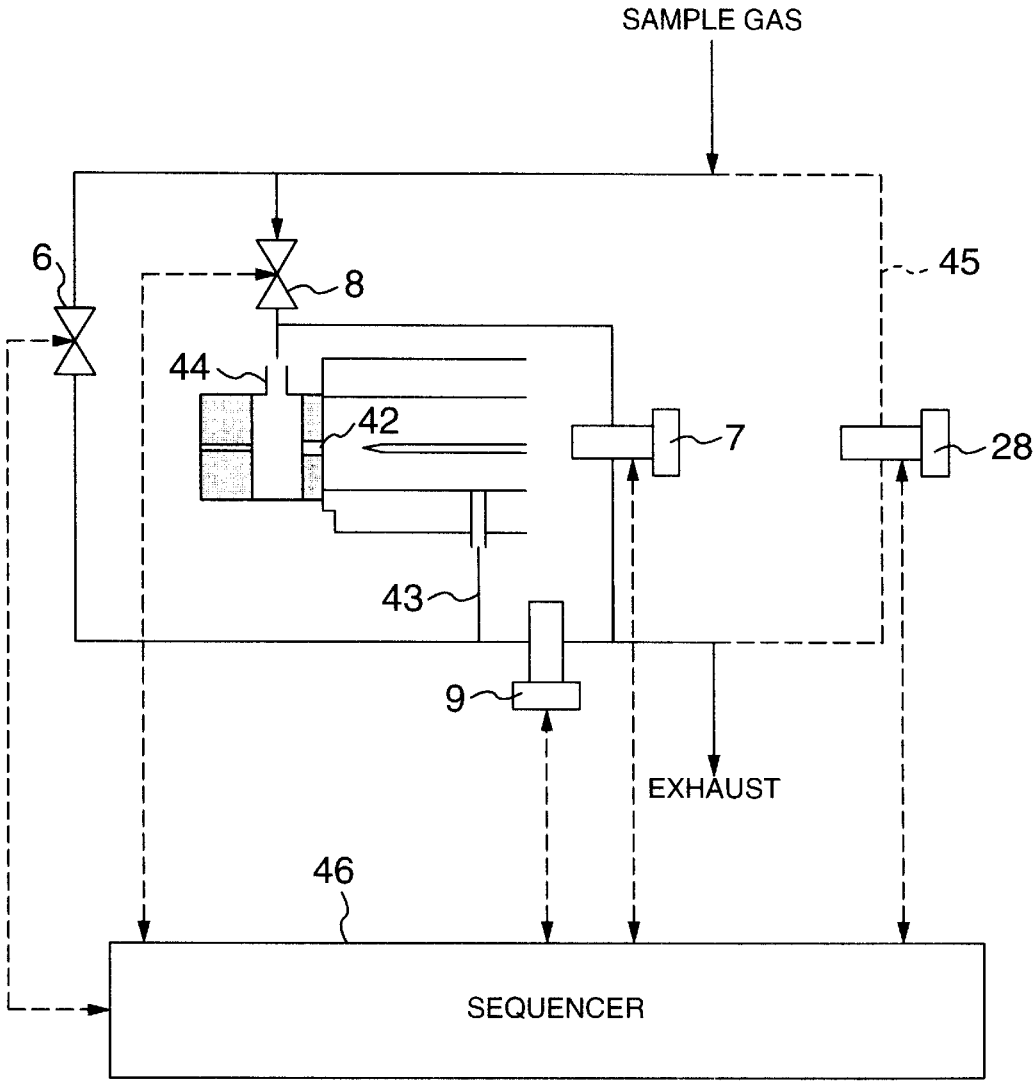
FIG. 3 is a diagram showing the ion source of the invention and the flow paths of the inlet/outlet pipes to/from the ion source.

FIG. 3 is a diagram showing a construction for the switching of flow paths in the positive and negative ion monitoring modes in another embodiment of the invention. When the sample gas is positively ionized, a mass flow controller 9 is set to 0-state (full close), and a valve 6 is opened so that the sample can be introduced into a region at around the root of the needle electrode 1. The sample is then forced to flow from that region via the aperture of draw-out electrode 2 to a mass flow controller 7 by which the amount of flow is controlled, and then it is exhausted. When the negative ion monitoring mode is switched to, a valve 8 is opened, the mass flow controller 9 is set to a proper flow rate (0.1~5 lit/min), the valve 6 is closed, and the mass flow controller 7 is set to 0-state (full close). The sample gas flow is turned opposite to the positive ion monitoring mode, or the ions flow and the sample gas flow are in the opposite directions in the corona discharge region.

If the valves 6, 8 are constructed to be automatically opened or closed like a solenoid valve, and if the front controller setting can be automatically operated, the same sample gas can be automatically measured with high sensitivity in both positive and negative monitoring modes by periodically switching those modes. The flow-path switching means for the positive and negative ion monitoring modes may be manual or use of a sequencer as shown in FIG. 3 or computer control.

It is desirable for the sample gas to be sucked in by a pump provided on the exhaust side in order that the constituents contained in the sample gas can be prevented from being absorbed within the pump or that the impurities within the pump can be prevented from being mixed with the sample gas, affecting the analysis. In addition, if bypass lines (indicated by the dotted lines in FIG. 3) are provided, the total amount of the sample gas can be increased, thus resulting in the increase of flow rate of the gas within the pipes. Therefore, the sample to be measured can be prevented from being attached to the walls of the pipes. If a mass flow controller 28 is provided in the bypass lines, the amount of gas to be introduced can be controlled constant. In either case, it is important that the pipes be heated up to 100° C. or above, preventing the attachment.

Figure 4:
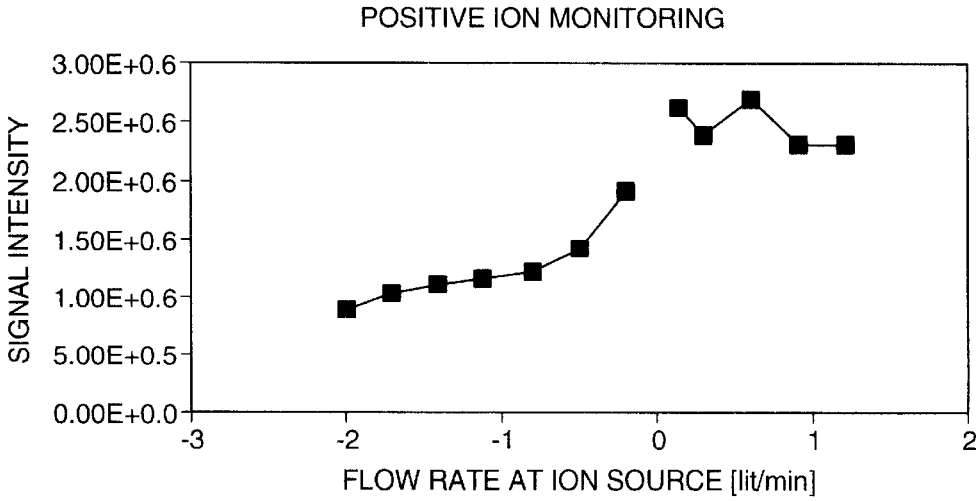
FIG. 4 is diagrams showing the characteristics of sensitivity to the flow rate within the ion source.
Figure 4:
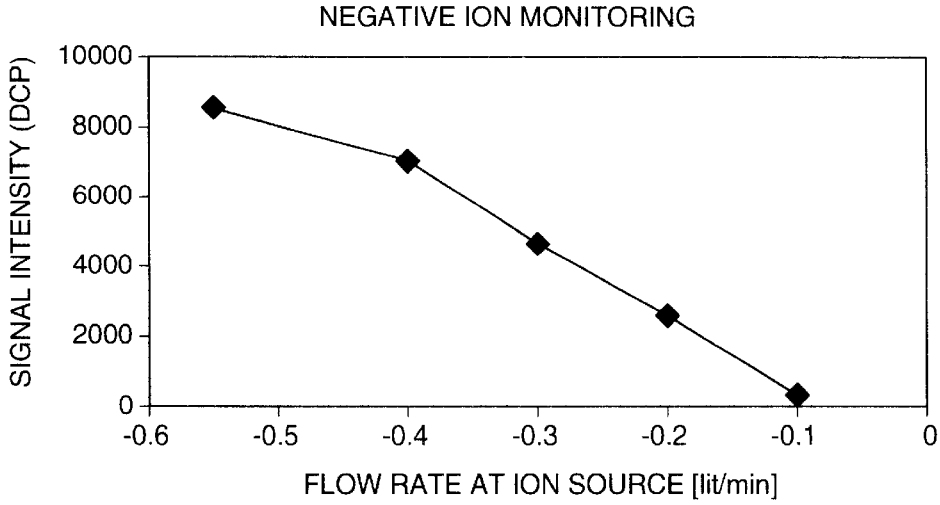

FIG. 4 is graphs of the results of examining the sensitivity in the positive and negative ion monitoring modes with the flow rate of sample gas changed. In the positive ion monitoring, a mixture of air and dichlorobenzene was used as the sample gas. In the negative ion monitoring, a mixture of air and dichlorophenol was used as the sample gas. In FIG. 4, the positive flow rate indicates that the direction in which the ions move is the same as that of the gas flow, and the negative flow rate indicates that those directions are opposite. In the positive ion monitoring, if the direction in which the ions move becomes opposite to that of the gas flow as described above, the transmission of the generated ions is inhibited so that the sensitivity lowers. In the negative ion monitoring, the sensitivity is extremely reduced if the flow rate decreases toward zero from the negative flow rate side.

A mass spectrometer will be described in detail with reference to FIG. 5. Although various different mass spectrometers can be used for analyzing the generated ions, use of an ion trap mass spectrometer will be described below. The same is true for other mass spectrometers such as the quadruple mass spectrometer using the same high-frequency electric field for mass separation, and the magnetic sector type mass spectrometer using the mass dispersion in a magnetic field.

The ions generated from an ion source 10 and passed through the draw-out electrode 2 are further passed through the first ion sampling aperture 3 (of about 0.3 mm in diameter and about 20 mm in length) provided in a first flange type electrode 11, a second ion sampling aperture 12 (of about 0.6 mm in diameter and about 0.3 mm in length), and then a third ion sampling aperture 13 (of about 0.3 mm in diameter and 0.3 mm in length), which apertures are heated by a heater (not shown). These apertures are heated up to a temperature range from about 100 to 300° C. by a heater (not shown). In addition, voltages are applied between the first ion sampling aperture 3 and the second ion sampling aperture 12, and between the second ion sampling aperture 12 and the third ion sampling aperture 13 so as to increase the ion transmission efficiency and at the same time so that the residual molecules are collided with the cluster ions produced by adiabatic expansion to split the cluster ions, thus producing ions of the sample molecules. The differential exhaust is normally use of a roughing vacuum pump such as a rotary pump, scroll vacuum pump or mechanical booster pump. A turbo-molecular pump may be used for this exhaust. In FIG. 5, a scroll vacuum pump 14 (of about 900 l/min in air volume displacement) is used for the differential exhaust, and a turbo-molecular pump 15 (of about 200 to 300 l/min in air volume displacement) for the exhaust of mass spectrometer. The scroll vacuum pump 14 is used both as the above and as a pump for exhausting the back pressure of the turbo-molecular pump 15. The pressure between the second ion sampling aperture 12 and the third ion sampling aperture 13 is in the range from 0.1 to 10 Torr. In addition, two apertures of first ion sampling aperture 3 and third ion sampling aperture 13 may be used for the differential exhaust. However, since the amount of flowing-in gas increases as compared with the above case, it is necessary to increase the exhaust rate of the vacuum pump used or increase the distance between the apertures. Also, in this case, it is important to apply a voltage between the apertures.

The produced ions, after passing through the third ion sampling aperture 13, are focused by a focusing lens 16. This focusing lens 16 is normally a Einzuerun lens formed of three electrodes. The ions further pass through a slit-having electrode 17. The ions passed through the third ion sampling aperture 13 is focused on the slit by the focusing lens 16, while the neutral particles not focused collide with the outside of the slit, thus being made difficult to move to the mass spectrometer side. The ions passed through the slit-having electrode 17 are deflected and focused by a double cylindrical type lens 20 formed of an inner electrode 18 having a large number of openings and an outer electrode 19. In the double cylindrical type lens 20, the ions exuded through the openings of the inner electrode 18 are deflected and focused by the electric field from the outer electrode 19.

The ions passed through the double cylindrical type lens 20 are introduced into the ion trap mass spectrometer. The ion trap is formed of a gate electrode 21, end gap electrodes 22*a*, 22*b*, a ring electrode 23, shielding electrodes 24*a*, 24*b*, spacer rings 25*a*, 25*b* and an ion extract lens 26. The gate electrode 21 serves to prevent external ions from entering into the mass spectrometer when the ions caught within the ion trap mass spectrometer are taken out of the ion trap mass spectrometer. The ions introduced into the ion trap mass spectrometer through the ion sampling aperture 13 collide with the buffer gas such as helium introduced into the ion trap mass spectrometer so that their orbits are made small, and then exhausted, by the mass number at a time, out of the ion trap mass spectrometer through the ion extract aperture by scanning the frequency of the high-frequency voltage applied between the end gap electrode 22*a*, 22*b* and the ring electrode 23. The exhausted ions are passed through the ion extract lens 26 and detected by an ion detector 27. When the buffer gas is introduced into the ion trap mass spectrometer, the pressure within the spectrometer is about in the range from about $10^{-3}$~$10^{-4}$ Torr. The ion trap mass spectrometer is controlled by a controller of the mass spectrometer. One of the merits of the ion trap mass spectrometer is that since it has the characteristic of catching ions, the ions, even if the sample concentration is thin, can be detected by extending the accumulation time. Therefore, even if the sample concentration is low, high-power concentration of ions can be achieved at the ion trap mass spectrometer, and thus the pre-treatment such as the concentrating of the sample can be very simplified.

Figure 5:
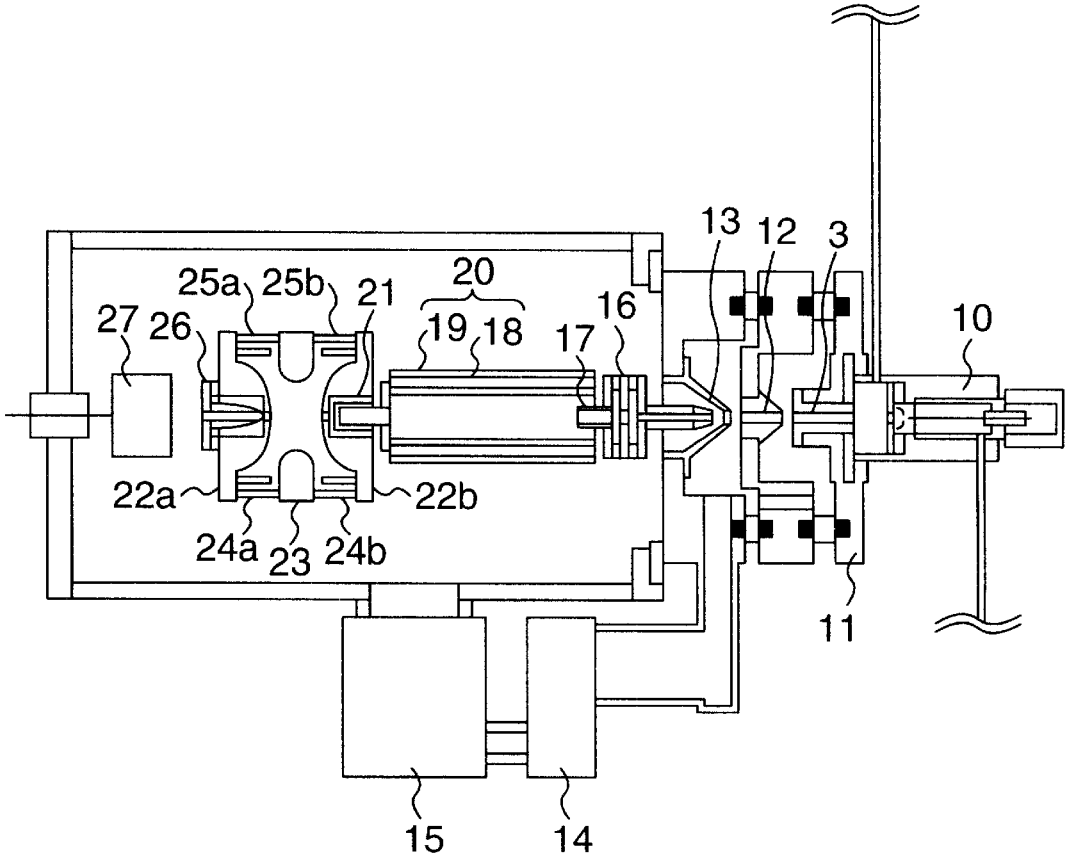
FIG. 5 is a diagram showing an example of the construction of the ion source and mass spectrometer according to the invention.
Figure 6:
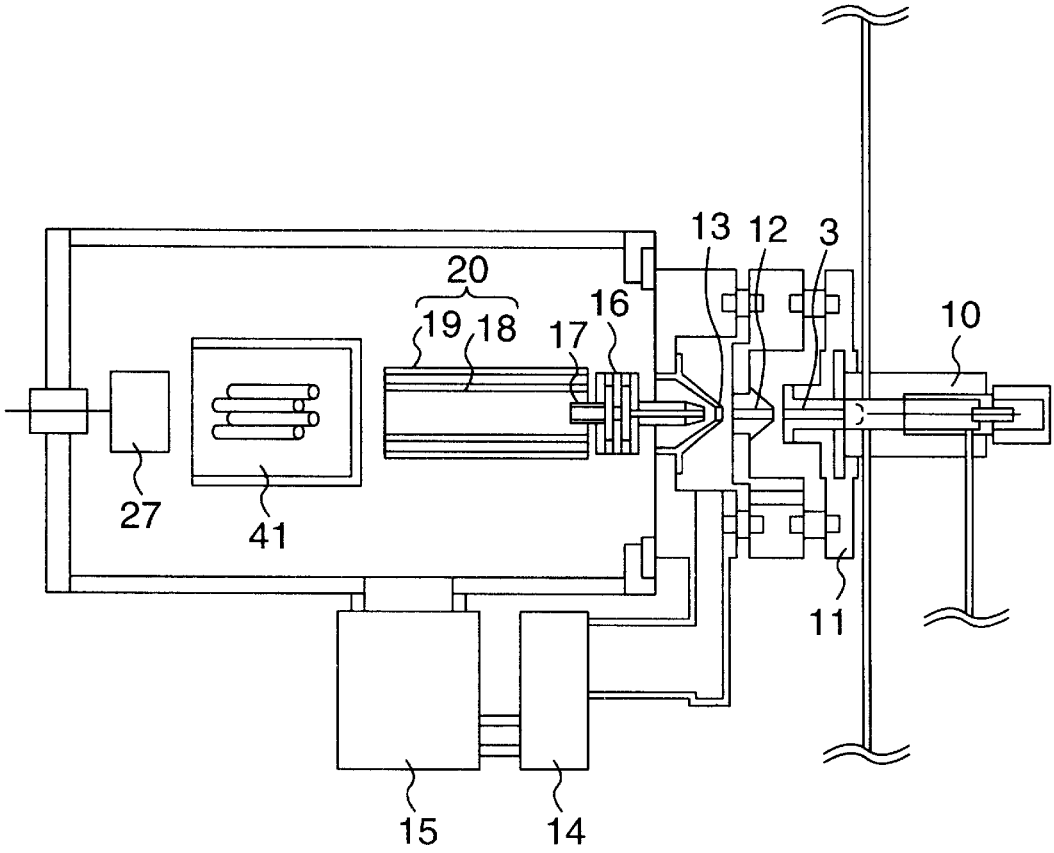
FIG. 6 is a diagram showing another example of the construction of the ion source and mass spectrometer according to the invention.

FIG. 6 show another structure that is different from FIG. 5 in the direction in which the sample to be introduced into the ion source 10 flows. If the sample gas is forced to flow from an opening 41 to the opening 42 in the negative ion monitoring mode, the direction of the sample flow is 90 degrees different relative to the line segment connecting the needlepoint and the opening 3, and the opening 42 from which the sample is discharged is at the same position of the needlepoint. In this case, the ions and neutral molecules respectively move in the directions substantially perpendicular to each other, and the effect similar to the case of FIG. 4 can be obtained by increasing the flow rate of the sample gas. In addition, if the directions in which the ions and the neutral molecules move have an angle relative to each other unlike the opposite directions or perpendicular directions, the same effect can be obtained. If the sample gas is forced to flow from an opening 43 to the opening 42 (or 41) in the positive ion monitoring mode, the gas flow does not interfere with the ion movement, and thus the transmission efficiency can be improved. A quadruple mass spectrometer is used in the structure of FIG. 6 as an example of not the ion trap type. In the cases where the sample is clean enough to have no chemical noise interference, and the reaction within the ion trap affects the measurement, the quadruple mass spectrometer shown in FIG. 6 can be used. The type of mass spectrometer is thus selected according to the property of the sample to be measured.

Figure 7:
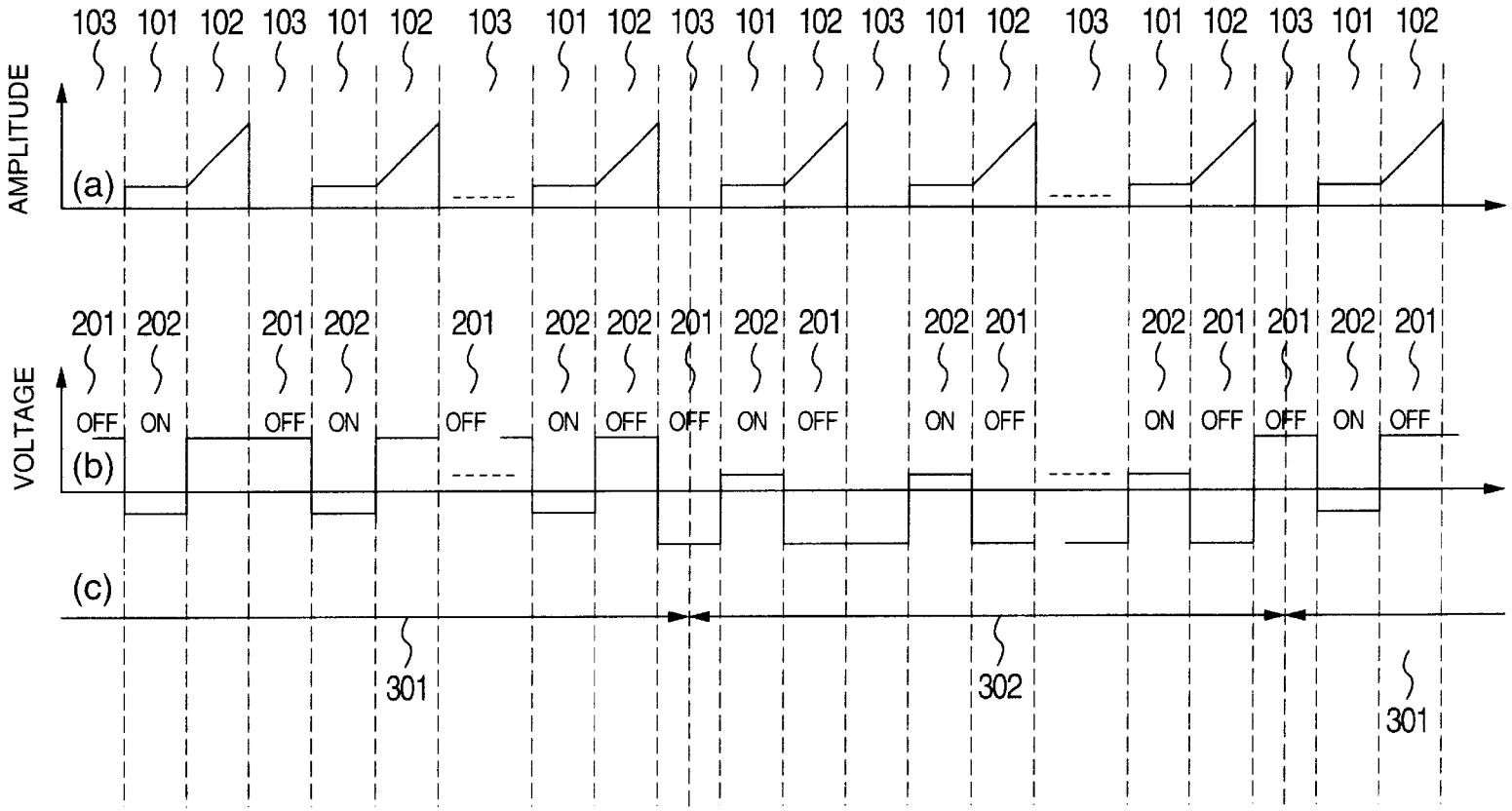
FIG. 7 is a diagram showing the switching of positive and negative ion monitoring modes by the polarity change of mass spectrometer.

FIG. 7 shows the switching of the polarities of voltages to be applied to the electrodes in the positive and negative monitoring modes.

The ionizing modes of the ion source, ion transmission modes of the ion optics, and ion detection modes (301, 302) of the detector are switched in synchronism with the high-frequency amplitudes (101 through 103) to be applied to the ring electrode. The voltages to be applied to the gate electrode are also alternately applied as at an interval (201) for permitting the ions to be transmitted, and an interval (202) for blocking off the ions, but the polarities of the voltages are inverted depending on the ion monitoring modes. In this way, by alternately using the positive and negative ion monitoring modes, it is possible to obtain information of positive and negative ions. In order to reverse the polarity of ions to be measured, it is necessary to invert the polarities of voltages that are applied to the ion optics such as ion source and ion orbit focusing lens, and to the detector. In the ion source, a high voltage is applied between the needle electrode 1 and the draw-out electrode 2, and positive and negative potentials are applied to the needle electrode in the positive and negative ion monitoring modes, respectively. Similarly, the polarities of the voltages to be applied to the ion optics and the detector also must be inverted according to the polarities of the ions to be measured. If the flow paths are switched as shown in FIG. 3 like the change of the voltage polarities at the time of switching the positive and negative ion monitoring modes, detection with high sensitivity can be performed. The measurement condition can be stabilized in a few seconds after the switching of positive and negative ion monitoring modes that follows the change of voltage polarities, but experience shows that it takes about one minute until the condition in which the sample can be analyzed stably is reached after the flow paths are switched. Thus, if the modes are switched at intervals of one minute to measure, a substance of which the positive ions can be measured with high sensitivity, and another substance of which the negative ions can be measured high sensitivity, of the same sample, can be substantially sequentially measured.

<An Example of Application to a Dioxin Monitor>

Figure 8:
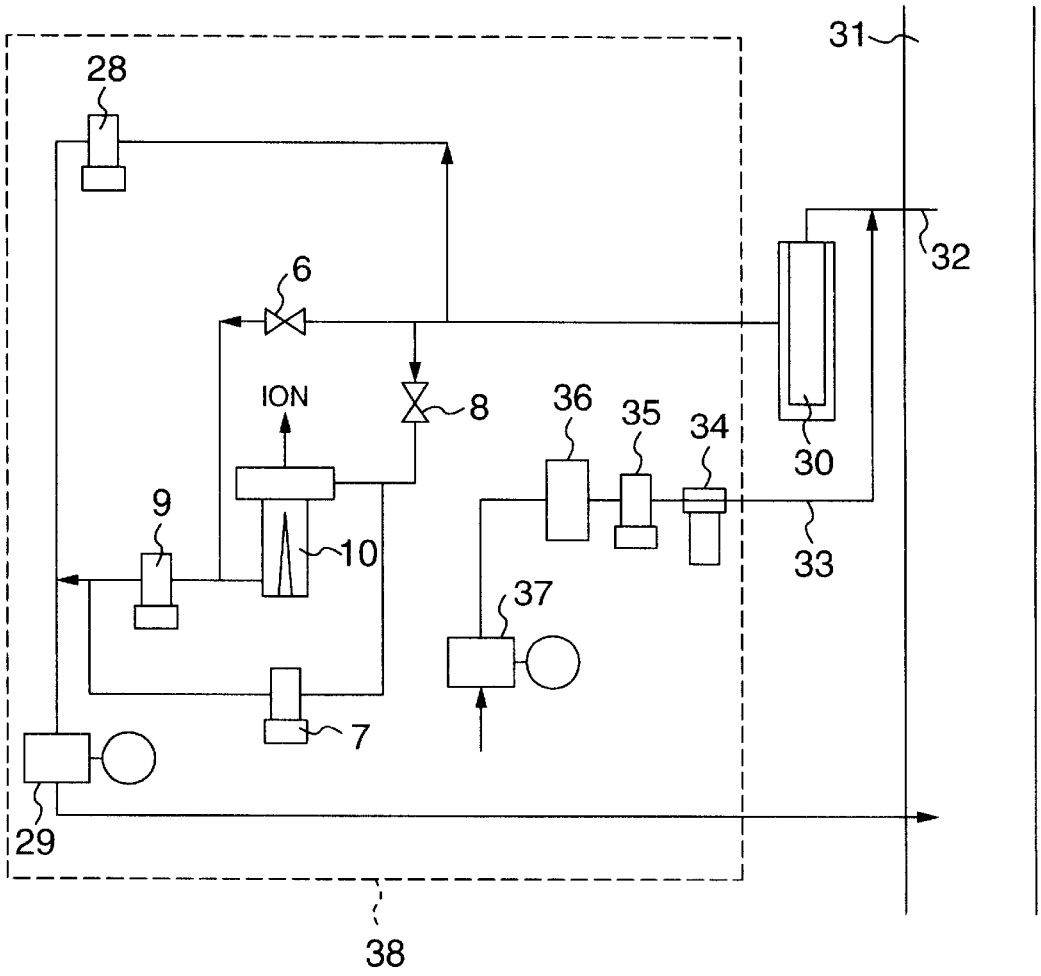
FIG. 8 is a diagram showing an exhaust-gas constituent analyzing system according to the invention.

An example of application of the ion source according to the invention to a dioxin precursor monitor will be described with reference to FIG. 8. The mass spectrometer using the ion source according to the invention can be connected directly to the incinerator or the like so that the incinerator flue gas ingredients can be continuously monitored. Particularly, by measuring dioxins, and the precursor of dioxins, or chloro benzene, chlorophenol and hydrocarbon, exhausted from the incinerator, and controlling the combustion condition according to the result, it is possible to greatly reduce the amount of production of dioxins from the incinerator. The sample gas is sucked in an on-line measuring device 38 from a stack 31 of the incinerator via the pipe 4 of a nozzle 32. The introduction of the gas into the on-line measuring device 38 is carried out by use of a pump 29, and the analyzed gas is exhausted through the stack 31 or exhausted after the harmful substances have been absorbed with activated charcoal or like. The gas sucked in from the stack 31, after particles called dust or mist are removed by a filter 30, is introduced into the measuring device 38. The standard sample gas to be added for calibration of concentration is added by taking air in by a pump 37, removing dust by a filter 36 and adding the air on the upstream gas of the filter 30 after passing through a standard sample generator 34. Alternatively, an air tank may be used in place of the pump 37 in order to obtain the standard sample.

The concentration of the standard sample is selected to be about the same as the average concentration of the sample substance contained in the exhaust gas that was previously measured by GC/MS or the like. If the concentration of chlorophenol in the stack is 1~10 $\mu g/Nm^3$ when measured, the concentration of the standard sample to be added is about 5 $\mu g/Nm^3$. Since the gas flow rate appropriate in the mass spectrometer is substantially 1~3 l/min, the extra gas is discharged through the bypass line. This bypass flow rate is controlled by a flowmeter 28. The flow direction of the sample gas to be introduced into the ion source 10 used in the mass spectrometer is changed by use of the valves 6,8 and mass flow controllers 7, 9 given in FIG. 3. At this time, since chlorobenzene and chlorophenol are respectively easy to be ionized into positive ion, and negative ion, the dioxin precursors of both chlorobenzene and chlorophenol can be substantially continuously measured by switching the positive and negative ion monitoring modes, and dioxin production at the time of the change of the combustion state can be suppressed by the combustion control.

The mass flow controllers and valves may be concentrically controlled by providing a computer or control sequencer or may be automatically controlled by providing control functions in the mass flow controllers and valves.

In addition, chlorophenol, when not only negatively ionized but also positively ionized into $M^+$, can be detected as positive ions. Since various different carbon hydride compounds are contained in the exhaust gas, chemical noise exists that overlaps on the mass number of the sample substance. However, when the quantitative values of the concentrations measured in the positive and negative ion monitoring modes are compared with each other, and when the result of either mode measurement is clearly found too high, it can be considered error due to the chemical noise. Thus, the measurement can be made in a higher accuracy mode. It is useful to select either one of the monitoring modes after the same substance is measured in the positive and negative ion monitoring modes and decided to have a value with higher sensitivity or with high precision.

The dioxin concentration is estimated from the concentrations of chrolobenzene and chrolophenol by the previously obtained correlation between both. Since the correlation is somewhat different depending on the system or type of the incinerator, to estimate the dioxin concentration with higher precision it is desirable to determine data of the correlation for each incinerator in which the monitor is installed. Moreover, although dioxins can be detected in the positive or negative ion monitoring mode, the positive ion monitoring mode often redundantly produces the chemical noise having the same mass number as dioxins, and thus it is advantageous to use MS/MS (multistage mass spectrometry) for noise-separated measurement.

<Example of the Application to Explosive/Drug Detection System>

Figure 9:
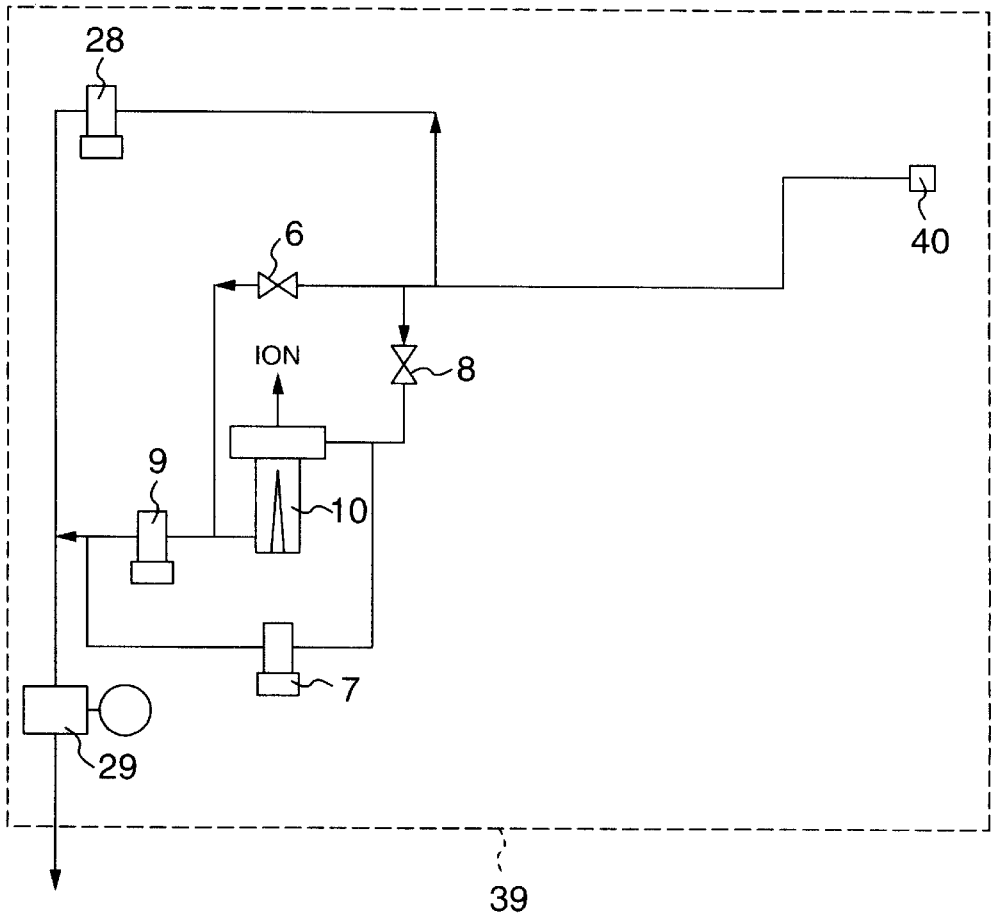
FIG. 9 is a diagram showing an explosive/drug detection system according to the invention.

An example of the application of this invention to explosive/drug detection system will be described with reference to FIG. 9. The positive/negative ion monitoring according to the invention is useful for the explosive/drug detection system that is used to detect the explosive and drug in public facilities such as airports. As substances easy to be positively ionized, there are stimulant drugs such as morphine and amphetamine/methane phetamine that have amino groups ($NH_2^-$). As substances easy to be negatively ionized, there are explosives having nitro groups ($NO_2^-$). Therefore, the presence or absence of this explosive/drug can be checked for baggage inspection in the custom office of airport or for inspection of suspicious boats. A slight sample to be detected, leaked from a baggage or a person is sucked in by use of a sampling probe 40. The sampling probe 40 may be of portable nozzle-type, or may be installed in the gate to suck in so that the sample can be detected when a person or baggage passes through the gate. By using the positive/negative ion monitoring technique according to the invention, it is possible not only to measure the positive/negative ions with high sensitivity on a single measuring device, but also to remarkably reduce the number of times that erroneous detection occurs about such a substance as can be measured in the positive/negative ion monitoring modes due to the influence of the chemical noise mentioned above. For example, if the sample is detected in the positive ion monitoring mode, and if the corresponding signal intensity on the mass spectrometer is found to be larger than a certain level, the negative ion monitoring mode is switched to so that it can be confirmed if the above fact is correct. In this case, if the signal intensity is again found to be larger than the certain level, an alarm is issued for the first time. By this measurement sequence, it is possible to make double confirmation, or detect with high accuracy. Thus, the vapor of explosive leaked from a baggage or cargo is sucked in, ionized and detected off line or on line by use of a probe or duct that absorbs the sample gas, so that it can be decided if there is any explosive.

The above measurement sequence is controlled by use of a computer installed within the mass spectrometer or a controller for all the explosive/drug detection system.

According to the invention, the directions in which the sample gas flows in the ionized region within the ion source are properly switched in the positive and negative ion monitoring modes so that both positive and negative ions can be detected with high sensitivity. By using this method, it is possible to substantially continuously measure chrolophenole/chrolobenzene, and two kinds of dioxin precursor contained in the exhaust gas on a single measuring device, and to make combustion control with high precision for suppressing the dioxin production. In addition, explosive/drag detection can be made with less error and with high accuracy.

The following items are disclosed in association with the present invention.

(1) A monitoring system including: an ion source that has a chamber having a needle electrode provided so as to ionize a sample to produce ions, a first opening through which the generated ions pass, a second opening that acts as an inlet or outlet for the sample, and a third opening that acts as an inlet or outlet for the sample, the second opening being disposed on the back of the tip of the needle electrode with respect to the central axis of the first opening; a mass spectrometer for analyzing the generated ions; a first pipe connected to the second opening; a second pipe connected to the third opening; first switching means for changing the direction of the sample flowing in the first pipe; and second switching means for changing the direction of the sample flowing in the second pipe.

(2) A monitoring system including: an ion source that has a chamber having a needle electrode provided so as to ionize a sample to produce ions, a first opening through which the generated ions pass, a second opening that acts as an inlet or outlet for the sample, and a third opening that acts as an inlet or outlet for the sample, an angle formed by line segments connecting a point of intersection between the central axis of the second opening and the inner wall of the chamber, the tip of the needle electrode, and a point of intersection between the central axis of the first opening and the inner wall of the chamber being larger than 90 degrees; a mass spectrometer for analyzing the generated ions; a first pipe connected to the second opening; a second pipe connected to the third opening; first switching means for changing the direction of the sample flowing in the first pipe; and second switching means for changing the direction of the sample flowing in the second pipe.

(3) A monitoring system according to the first item, wherein the directions of the sample flowing in the first and second pipes are switched according to the positive and negative polarities of ions generated from the ion source.

(4) A monitoring system according to the first item, further including control means for controlling the first switching means and the second switching means.

(5) A monitoring system according to the first item, further including bypass lines connected to the first and second pipes.

(6) A monitoring system according to the fifth item, further including mass flow controllers provided in the bypass lines.

(7) A monitoring system according to the first item, further including a cooler for cooling the sample, provided in the first or second pipe.

(8) A monitoring system according to the first item, wherein the same sample is measured in the positive and negative ion monitoring modes, and when the calibrated concentration value of either the detected positive ions or the detected negative ions is detected to be higher than a predetermined calibrated concentration value, the directions of the sample flowing in the first and second pipes are respectively reversed.

What is claimed is:

1. An ion source comprising:

a chamber having a needle electrode to ionize a sample to generate ions;

a first opening through which said generated ions pass; and a second opening which acts as an inlet or an outlet for said sample and is disposed on a back side of a tip of said needle electrode with respect to the central axis of said first opening, wherein, in a positive ionization mode, said second opening is switched to act as said inlet for said sample, said sample is introduced from said second opening into said chamber, positive ions are generated by a positive corona discharge by changing said needle electrode to a positive voltage, and said sample is discharged from said chamber via said first opening, and wherein, in a negative ionization mode, said second opening is switched to act as said outlet for said sample, said sample is introduced from said first opening into said chamber, negative ions are generated by a negative corona discharge by changing said needle electrode to a negative voltage, and said sample is discharged from said chamber via said second opening.

2. An ion source according to claim 1, wherein said first opening is located in front of said tip of said needle electrode with respect to the central axis of the first opening.

3. An ion source comprising:

a chamber having a needle electrode to ionize a sample to generate ions;

a first opening through which said generated ions pass;

a second opening which acts as an inlet or an outlet for said sample and is disposed on a back side of a tip of said needle electrode with respect to the central axis of said first opening; and a third opening which acts an inlet or outlet for said sample and is disposed in front of said tip of said needle electrode with respect to the central axis of said first opening, wherein an angle formed between the central axis of said first opening and a line segment connecting the tip of said needle electrode and a point at which the central axis of said second opening intersects with the inner wall of said chamber is more than 90 degrees, and an angle formed between the central axis of said first opening and a line segment connecting the tip of said needle electrode and a point at which the central axis of said third opening intersects with the inner wall of said chamber is less than 90 degrees, wherein, in a positive ionization mode, said second opening is switched to act as said inlet for said sample, said third opening is switched to act as said outlet for said sample, said sample is introduced from said second opening into said chamber, positive ions are generated by a positive corona discharge by changing said needle electrode to a positive voltage, and said sample is discharged from said chamber via said third opening, and wherein, in a negative ionization mode, said third opening is switched to act as said inlet for said sample, said second opening is switched to act as said outlet for said sample, said sample is introduced from said third opening into said chamber, negative ions are generated by a negative corona discharge by changing said needle electrode to a negative voltage, and said sample is discharged from said chamber via said second opening.

4. A mass spectrometer comprising:

an ion source having a chamber which comprises a needle electrode to ionize a sample to generate ions, a first opening through which said generated ions pass, and a second opening which serves as an inlet or an outlet for said sample and is disposed on a back side of a tip of said needle electrode with respect to the central axis of said first opening;

a mass spectrometry portion for mass spectrometry of said generated ions;

a detector for said mass-analyzed ions;

an electrode having an aperture through which said generated ions are introduced into said mass spectrometry portion; and an electrostatic lens to separate neutral particles and said ions which pass through said electrode, wherein, in a positive ionization mode, said second opening is switched to act as said inlet for said sample, said sample is introduced from said second opening into said chamber, positive ions are generated by a positive corona discharge by changing said needle electrode to a positive voltage, and said sample is discharged from said chamber via said first opening, and wherein, in a negative ionization mode, said second opening is switched to act as said outlet for said sample, said sample is introduced from said first opening into said chamber, negative ions are generated by a negative corona discharge by changing said needle electrode to a negative voltage, and said sample is discharged from said chamber via said second opening.

5. A mass spectrometer according to claim 4, wherein said first opening is located in front of said tip of said needle electrode with respect to the central axis of the first opening.

6. A mass spectrometer comprising:

an ion source having a chamber which comprises a needle electrode to ionize a sample to generate ions, a first opening through which said generated ions pass, a second opening which serves as an inlet or an outlet for said sample and is disposed on a back side of a tip of said needle electrode with respect to the central axis of said first opening, and a third opening which acts as an inlet or outlet for said sample and is disposed in front of said tip of said needle electrode with respect to the central axis of said first opening;

a mass spectrometry portion for mass spectrometry of said generated ions;

a detector for said mass-analyzed ions;

an electrode having an aperture through which said generated ions are introduced into said mass spectrometry portion; and an electrostatic lens to separate neutral particles and said ions which pass through said electrode, wherein an angle formed between the central axis of said first opening and a line segment connecting the tip of said needle electrode and a point at which the central axis of said second opening intersects with the inner wall of said chamber is more than 90 degrees, and an angle formed between the central axis of said first opening and a line segment connecting the tip of said needle electrode and a point at which the central axis of said third opening intersects with the inner wall of said chamber is less than 90 degrees, wherein, in a positive ionization mode, said second opening is switched to act as said inlet for said sample, said third opening is switched to act as said outlet for said sample, said sample is introduced from said second opening into said chamber, positive ions are generated by a positive corona discharge by changing said needle electrode to a positive voltage, and said sample is discharged from said chamber via said third opening, and wherein, in a negative ionization mode, said third opening is switched to act as said inlet for said sample, said second opening is switched to act as said outlet for said sample, said sample is introduced from said third opening into said chamber, negative ions are generated by a negative corona discharge by changing said needle electrode to a negative voltage, and said sample is discharged from said chamber via said second opening.

7. A mass spectrometer according to claim 4, wherein the positive and negative ion monitoring modes of said spectrometer are switched according to the positive or negative polarity of said generated ions.

8. A mass spectrometer according to claim 6, wherein a voltage to be applied to said electrode having said opening is changed to positive or negative polarity of said generated ions.

9. A mass spectrometer according to claim 8, wherein when said generated ions are positive, a positive voltage is applied to said electrode, and when said generated ions are negative, a negative voltage is applied to said electrode.

* * * * *